US006021931A

United States Patent [19]

Plastino

[11] Patent Number: 6,021,931

[45] **Date of Patent: *Feb. 8, 2000**

[54] COMBINATION AUTO MOLD MACHINE AND COOLING RACK FOR SHAPING AND SIZING HATS

[76] Inventor: Mario A. Plastino, 40 Roneck Ct., Shirley, N.Y. 11967

[ * ] Notice: This patent is subject to a terminal disclaimer.

[21] Appl. No.: 08/989,276

[22] Filed: Dec. 12, 1997

Related U.S. Application Data

[63] Continuation-in-part of application No. 08/666,867, Jun. 19, 1996, Pat. No. 5,732,858, which is a continuation-in-part of application No. 08/599,633, Feb. 9, 1996, Pat. No. 5,590, 820.

[51] Int. Cl.[7] ..... A42C 1/04

[52] U.S. Cl. ..... 223/12; 223/7; 223/57

[58] Field of Search ..... 223/12, 13, 24, 223/26, 52, 57, 7; 425/398, 412, 416; 264/324

[56] References Cited

U.S. PATENT DOCUMENTS

| | | | |
|---|---|---|---|
| 755,365 | 3/1904 | Cuming . | |
| 1,392,605 | 10/1921 | Stevens . | |
| 2,370,553 | 2/1945 | Lornitzo | 233/57 |
| 2,724,530 | 11/1955 | Cottrell et al. | 233/12 |
| 4,648,934 | 3/1987 | Kiss | 156/443 |

FOREIGN PATENT DOCUMENTS

| | | |
|---|---|---|
| 47-20015 | 9/1972 | Japan . |
| 282560 | 12/1927 | United Kingdom . |

OTHER PUBLICATIONS

Advertisement for two hat making machines, Michelagnoli, Florence, Italy, undated.

"Headware Engineering", pp. 9–11 and "How Hats are Made" pp. 38–42 in *Hat Life Yearbook and Directory,* 1984–1985 Edition, Pellon Corporation, New York, New York.

*Primary Examiner*—Bibhu Mohanty

*Attorney, Agent, or Firm*—Alfred M. Walker

[57] ABSTRACT

A combination automatic molding machine and associated cooling rack for pressed items, such as hats, using advanced features which produce a pressed items, such as a completed hat form from an unshaped configuration of a moldable material, such as felt, wool or straw. The combination can also be used to produce other flexible, inelastic fabric structures, such as molded insulation members within a wall or vehicle body. When a hat is first taken from the hat molding machine at a first large size, it is then placed upon the cooling rack, where the size is further varied by placing corresponding male crown inserts extending up from a flange placed upon the cooling rack. Preferably the male inserts are made of ABS Plastic. In effect, the molding rack is used to vary sizes for each hat upon the cooling rack. While the hat is in a warm, malleable state of a large size, the hat thus formed is squeezed through a fenestration hole of a smaller size reducer. A larger sized hat is squeezed through the hole, to reduce the open crown size from a predetermined larger size to a predetermined smaller size. The hat is further sized smaller by placing an annular foam ring sweat band within the hat. Preferably, the foam is polyethylene foam covered by a porous, sweat absorbing material, such as satin. Use of a foam sweatband can further change the size in one hat, since in its compressed state the foam sweat band will accommodate a slightly larger hat size, such as 7⅜, as opposed to a slightly smaller hat size, such as 7¼. Furthermore, in an alternate safety guard embodiment, the hat molding machine portion includes a guide track, upon which track a transparent guard is raised or lowered, to alternately expose and deny access to the moving parts of the manually accessible control panel.

3 Claims, 13 Drawing Sheets

COMBINATION AUTO MOLD MACHINE AND COOLING RACK FOR SHAPING AND SIZING HATS

This application is a continuation-in-part of U.S. Ser. No. 08/666,867 filed Jun. 19, 1996, now U.S. Pat. No. 5,732,858 which is a continuation-in-part of U.S. application Ser. No. 08/599,633 filed Feb. 9, 1996, now U.S. Pat. No. 5,590,820 dated Jan. 7, 1997. This application is also based upon Disclosure Document No. 411972 of Jan. 24, 1997.

FIELD OF THE INVENTION

The hat molding machine and associated cooling rack of the present invention uses advanced features to produce a completed hat form of various shapes and hat sizes from an unshaped felt, wool or straw configuration. The combination includes a machine which employs male and female hat molds for sizing a hat, as well as a cooling rack for the dual function of further sizing the hat while the hat cools in a malleable state upon the cooling rack.

A two step process of forming hats is employed. First the hat molding machine makes a particular size hat in a warm, malleable state. Then the hat is placed upon a cooling rack, where the malleable hat is further sized while being passively reduced in size upon modular inserts located upon the cooling rack.

The female hat mold of the hat molding machine has embedded electric heating elements which are temperature controlled. Low pressure steam is piped into the female mold. Using three pneumatic cylinders and an automatic programmable air controller with timer for proper sequencing, a completed hat form shape including crown shape portion and flange brim portion results. To first vary the size of the hat, the male and female crown portions of the mold are interchangeable. Then, if further size increase is needed, the hat is placed upon the respective inserts, so that the exterior of the inserts passively pushes the malleable crown portion inward to a smaller size.

While the hat molding machine is in use, it contains hazardous hot and moving parts. Therefore, an optional embodiment includes a window pane type of guard, which blocks the operative buttons, while in a position of non-use. The pane is raised during use to expose the operative buttons but to block access to the hot moving parts.

BACKGROUND OF THE INVENTION

Fur or wool felt hats start out as a cone that is roughly shaped to a raw body by stretching. It is then further processed in a labor-intensive sequence of steps to the familiar hat shape. Two theories of the formation of felt itself, the intertwining and plastic theories, seem to be the basis also for the later steps of hat shaping. According to the intertwining theory, the fibers are mechanically manipulated and forced among each other. The plastic theory holds that the fur or wool fibers become temporarily plastic at elevated temperatures. The hand process involves blocking the crown and flanging the brim.

Skilled crafts people using simple fixtures or machines can perform these operations. Crown stretching is done on a fixture which has a frame over which the rough felt cone is placed. Metal fingers press the felt at the tip between frame members thereby stretching it. The brim stretcher also uses metal fingers to grip the brim to stretch it to shape. The hat is then roughly blocked into shape by wetting and then pulling it over a wooden block. The final blocking steps for final size are done with the aid of steam and an iron. The hat form is finally finished on a hand-carved block that produces the final style or "character" of the shape.

More sophisticated machines for automating some of the steps in hat making have been around for over a hundred years. Starting with a raw felt body, one process involves forming the brim flange by stretching this region using metal fingers before applying steam. The body with the formed brim is then dried on a rack. The dry hat is then put into a female mold and a rubber bladder is inserted in the crown portion and expanded by hydraulic pressure so that the crown is expanded into intimate contact with the female mold. Michelangnoli, a company in Signa, Italy, makes an automatic machine based on this hydraulic principle. Other machines, such as automatic stampers, are used to achieve a final shape to the hat form. Hat sizes are varied by changing the size of the crown portion worn upon the head. Hat sizes are generally characterized as either "small", "medium" or "large". The "small" men's hat size varies between 20 and 21.5 inches in circumference. The "medium" men's hat size varies between 22 inches and 23 inches in circumference and the "large" men's hat size varies between 23.5 and 24.5 inches in circumference. Equivalent size gradations are also applicable for women's hat sizes.

Within each size, the circumferences are varied by adding adjustable trim bands, such as sweat bands, to vary the size of the hat within a particular size.

For example, a "medium" men's hat size will vary between 22 and 23 inches circumference by adding adjustable trim bands therein.

However, to vary the hat size in conventional hat making machines is both time consuming and cumbersome.

My prior art U.S. Pat. No. 5,590,820 solves some of these problems by providing a hat molding machine, which includes a male crown portion insertable within a fenestration hole within a female brim portion, wherein steam and heat is applied to a raw hat form therebetween. The hat thus formed is quickly molded to a sturdy hat. However, changing the hat size with my original hat holding machine required changing the male and female molds.

To solve the problem of providing hats of various sizes, my co-pending under Ser. No. 08/666,867 discloses the use of a plurality of different sized male hat molds, together with female insert members having open fenestration holes of different sizes to accommodate the male insert members therein. However, changing the sizes using my process describes in my co-pending application filed as Ser. No. 08/666,867 required shutting down the hat molding machine to change the male crown inserts and the female inserts, each with a fenestration hole therein. Therefore there is a need to further make hats of varying sizes without having to constantly turn the hat molding machine off.

OBJECTS OF THE INVENTION

It is therefore an object of the present invention to make hats of varying sizes while minimizing the need to shut a hat molding machine down while changing desired hat sizes.

It is also an object of this invention to eliminate the manual or separate machine steps of blocking and flanging of hat making.

It is yet another object to produce various size hats in an efficient manner.

It is a further object to mold an average of fifty western hat forms in felt or wool per hour.

It is yet a further object to reduce the skill level of the hat making machine operator and to improve hat making yields compared to manual operations or those using prior art machines.

It is also an object to make molded hat bodies that maintain felt or wool thickness at the brim and crown, which is presently a limitation of the prior art machines.

By using steam and controlled heat, it is an object of this invention to form both the crown and brim portions of a hat in an automated process which includes both active and passive hat making and shaping functions.

It is yet another object to manually set up a hat making machine which can actively make a hat of a particular shape and size, and then switch to a passive operation for the remainder of a production of the hat.

It is a further object of the present invention to provide a movable, transparent safety guard for manually operated industrial machinery, such as a hat molding machine.

It is yet another object to improve over the disadvantages of the prior art.

SUMMARY OF THE INVENTION

In keeping with these objects and others which may become apparent, the present invention includes a combination automatic molding machine and associated cooling rack for pressed items, such as hats, using advanced features which produce a pressed items, such as a completed hat form from an unshaped configuration of a moldable material, such as felt, wool or straw. The combination can also be used to produce other flexible, inelastic fabric structures, such as molded insulation members within a wall or vehicle body.

In the preferred embodiment for hat making, the machine employs male and female hat molds. The female hat mold has embedded electric heating elements which are temperature controlled. Low pressure steam is piped into the female mold. Using a source of pressure, such as three pneumatic cylinders, and an automatic programmable air controller with a timer for proper sequencing, a completed hat form shape including crown shape portion and flange brim portion results. The hat thus formed is placed in its warm, malleable state upon a cooling rack, where it is subject to active exertion of force from being squeezed through various sized insert reducer members upon the cooling rack to further change the size of the hat. The hat is also subject to passive force while being retained in place within the sized insert reducer member.

The combination hat molding machine and cooling rack uses advanced features to produce a completed hat form from an unshaped felt, wool or straw configuration form to a completed hat form shape, including a crown shape portion and a flange brim portion. The hat making machine includes a male hat mold and a reciprocal female hat mold, wherein either one or both may move toward the other mold. The male hat mold includes two separate movable parts, namely an outer brim flange portion with a central orifice to accommodate the insertion of an inner crown portion therethrough. In contrast, the outer brim flange portion of the female mold is integral with the centrally located hollow crown portion of the female mold.

The outer brim flange portion of the male hat mold and the reciprocal brim flange portion of the female hat mold clamp the brim flange portion of the raw unshaped hat form in a tight cavity formed therebetween. The tight cavity formed between the brim flange portion of the male hat mold and the brim flange portion of the female mold takes the place of traditional stretching of the outer portions of the brim with metal finger clamps. In sequence, the outer brim flange portion is first advanced down to squeeze the brim of the raw felt form. Thereafter, the protruding crown portion of the male mold is advanced down toward the hollow crown portion of the female mold, to stretch the crown portion of the raw hat form into the desired crown shape.

As the two portions of the male hat mold are independently advanced toward the respective portions of the female hat mold, the male hat mold and the female hat mold are provided sequentially with a source of heat, such as one or more heating elements and a source of moisture vapor, such as steam.

The source of heat increases the temperature of the male hat mold and the female mold to a predetermined temperature for a predetermined period of time.

Likewise, the source of moisture supplies moisture vapor steam in a gaseous state to the male hat mold at a predetermined pressure and temperature for a second predetermined period of time. The source of heat and the source of moisture vapor are provided sequentially predetermined periods of time sufficient to clamp and squeeze the raw hat form to the desired completed hat shape.

During the sequence of operations, the movements of the movable male hat mold are controlled, and an air controller controls a steam switch and a heater element in a predetermined sequence for a desired duration of time to form a completed hat.

To vary hat sizes, the respective male and female crown mold portions may be interchangeable with other male and female crown mold portions corresponding to varying hat sizes.

In changing a hat size, from a "large" size designation, the largest male crown portion is removed from the male hat mold portion of the hat making machine, and replaced with another smaller male crown portion, such as corresponding to "small" or "medium" hat sizes.

Thereafter, a hollow insert corresponding to either a "small" or "medium" size crown is inserted within the open female crown mold portion to reduce the interior circumference of the crown of the hat being made.

When the upper, male crown mold portion preferably protrudes downward, facing the lower open female crown mold portion, it must be retained by a fastener means from above. The lower female crown mold insert can be held in place by gravity within the larger female crown mold portion.

It is also known that these respective upper and lower locations of the male and female crown portions can be reversed, however, positioning of the male crown mold portion on the bottom and the female crown insert portion on the top requires both portions to be fastened in place.

When the hat is taken from the hat molding machine, it is then placed upon the cooling rack, where the size is further varied by placing corresponding male crown inserts into the crown portion of the hat, while squeezing the crown of a first larger predetermined size in a fenestration hole of a predetermined smaller size within a reducer flange placed upon the cooling rack. Preferably the male inserts are made of ABS plastic.

In effect, the molding rack is used to vary sizes for each hat upon the cooling rack. While the hat is in a warm, malleable state of a large size, the hat thus formed is squeezed through the fenestration hole of the smaller size reducer. As noted above, the larger sized hat is squeezed through the hole, to reduce the open crown size from a predetermined larger size to a predetermined smaller size. The entire cooling process takes about 70 seconds, with no need to shut down the basic hat molding machine.

The hat is further sized smaller by placing an annular foam ring sweat band within the hat. Preferably, the foam is polyethylene foam covered by a porous, sweat absorbing material, such as satin. Use of a foam sweatband can further change the size in one hat, since in its compressed state the foam sweat band will accommodate a slightly larger hat size, such as 7⅜, as opposed to its uncompressed state, where the foam sweat band is associated with a slightly smaller hat size, such as 7¼.

For example, hats are made in two sizes, where the foam sweat band in its compressed or uncompressed state accommodates larger or smaller sizes. For a small size hat, using standard hat measurement units, placing a small size insert crown into a hat upon the cooling rack, produces a small size, such as size 6¾. After insert of the sweat band, the hat now accommodates a size 6¾ when the foam is not compressed. When the foam is compressed by a slightly larger head, the hat size is now 6⅞.

Other insert crowns and corresponding small fenestration holes in support flanges for the brim of the hat upon the cooling rack produce other pairs of sizes, such as 7 and 7⅛ (corresponding to a 23½ inch circumference) or 7¼ and 7⅜ (corresponding to a 24 inch circumference). The largest pair of sizes, such as 7½ and 7⅝, can be produced by having no reduction in size while the hat thus formed is cooled upon the cooling rack.

Furthermore, in the safety guard embodiment of the present invention, the hat molding machine portion includes a guard support, such as a guide track, upon which track a transparent plastic, glass or screen guard is raised or lowered, to alternately expose and deny access to the moving parts of the manually accessible control panel for the hat molding machine.

DESCRIPTION OF THE DRAWINGS

The present invention can best be understood in conjunction with the accompanying drawings, in which:

FIG. 3A is a schematic side view of an alternate embodiment for making a smaller size hat;

DETAILED DESCRIPTION OF THE DRAWINGS

Figure 1:
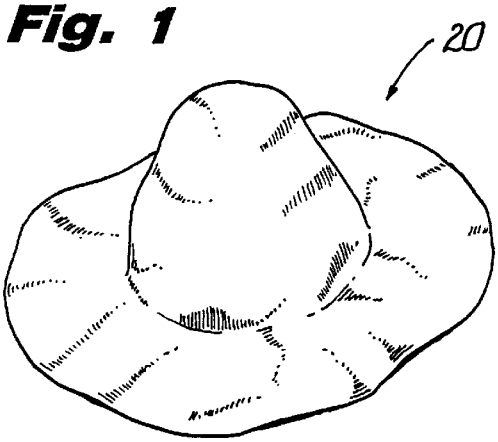
FIG. 1 is a perspective view of raw hat body.
Figure 2:
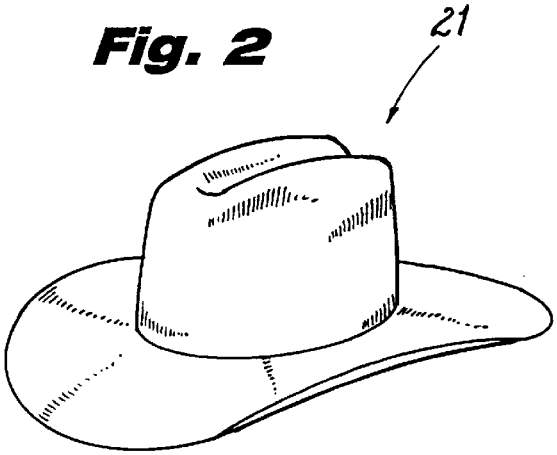
FIG. 2 is a perspective view of a molded hat body.

FIG. 1 shows a prior art raw body 20 of a hat which is a very roughly shaped felt configuration. FIG. 2 shows a molded body 21 or finished hat shaped form. The hat making machine of the present invention starts with the raw body 20 and produces molded body 21.

Figure 3:
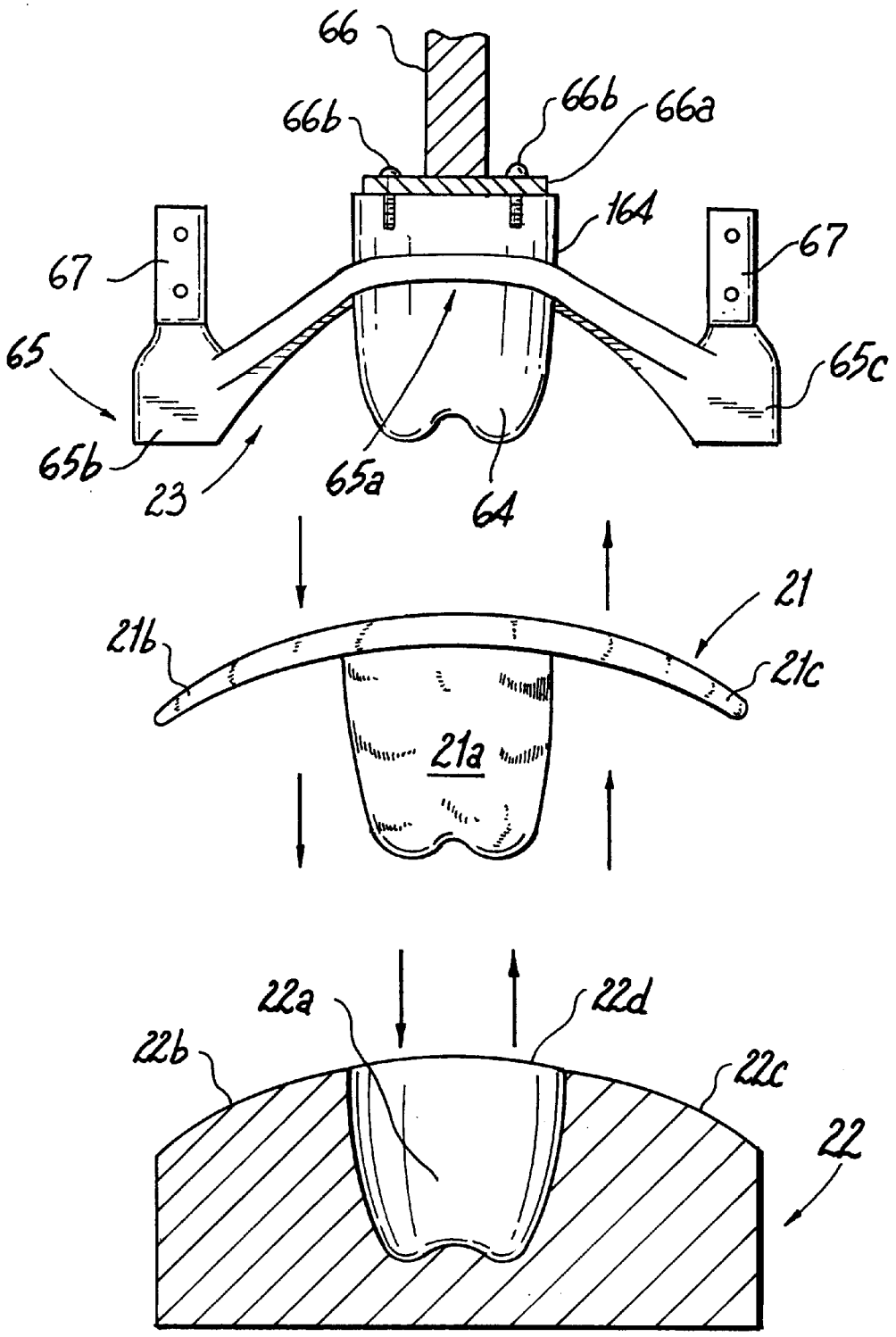
FIG. 3 is a schematic side view of a hat making machine of the present invention showing the relationship between the female mold, male mold and felt hat form.

FIG. 3 shows the relative positions of the female mold 22, the movable male mold 23 and the felt hat 21 being formed sandwiched between. Elements of the machine to be described bear a close relationship to this diagram.

Female mold 22 includes a hollow cavity 22*a* having a shape corresponding to the exterior finished shape of crown portion 21*a* of hat 21. Female mold 22 also includes shoulders 22*b*, 22*c* corresponding the left and right brim portions 21*b*, 21*c* of hat 21.

While FIG. 3 shows a cutaway sectional view through the center of female mold 22, showing left and right brim portions 22*b*, 22*c* being separated, in reality brim portions 22*b*, 22*c* are the left and right contiguous portions of the annular brim surrounding crown cavity 22*a* of female mold 22 along top edge 22*d* thereof.

Male mold 23 includes protruding movable male crown mold 64 and flange brim mold 65 having central aperture 65*a* for insertion of male crown mold 64 corresponding therein and left and right shoulders 65*b*, 65*c* corresponding to respective left and right brim portions 21*b*, 21*c* of hat 21.

Male crown mold 64 is removably attached to coupling plate 66*a* by means of fasteners 66*b*, such as screws, which coupling plate 66*a* is attached to and supported by coupling 66 supporting male crown mold 64 therefrom.

Moreover, flange brim mold 65 is supported by coupling members 67.

As shown in FIG. 3, hat 21 is squeezed between male mold 23 and female mold 22, by virtue of the downward movement of the mold 23 against hat 21 in a raw body shape within female mold 22. As discussed hereinafter, steam and heat is simultaneously applied within female mold 22 while male mold 23 applied mechanical force against both hat 21 and female mold 22, thereby shaping hat 21 to a desired semi-rigid shape.

In the alternate embodiment shown in FIG. 3A, a smaller male crown mold 164 is attached to coupling plate 66*a* by fasteners 66*b*. To reduce the size of female mold cavity 22*a* of female mold 22, insert 140 is inserted therein, to create a smaller cavity 142 for producing a smaller size hat 121.

The process to be described uses steam, electric heating elements and pressure from pneumatic cylinders to accomplish the molding operation. However, other sources of power, such as hydraulic power and electronic power, may be provided.

Figure 4:
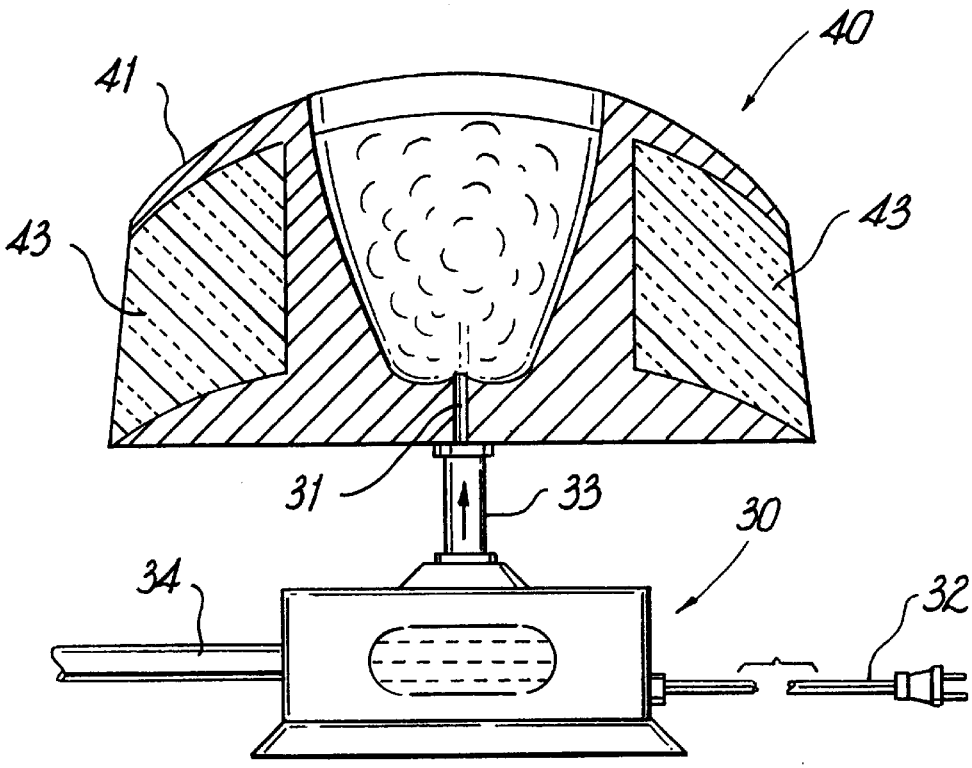
FIG. 4 is a side cross section showing steam use in a female mold of the hat making machine of the present invention.
Figure 5:
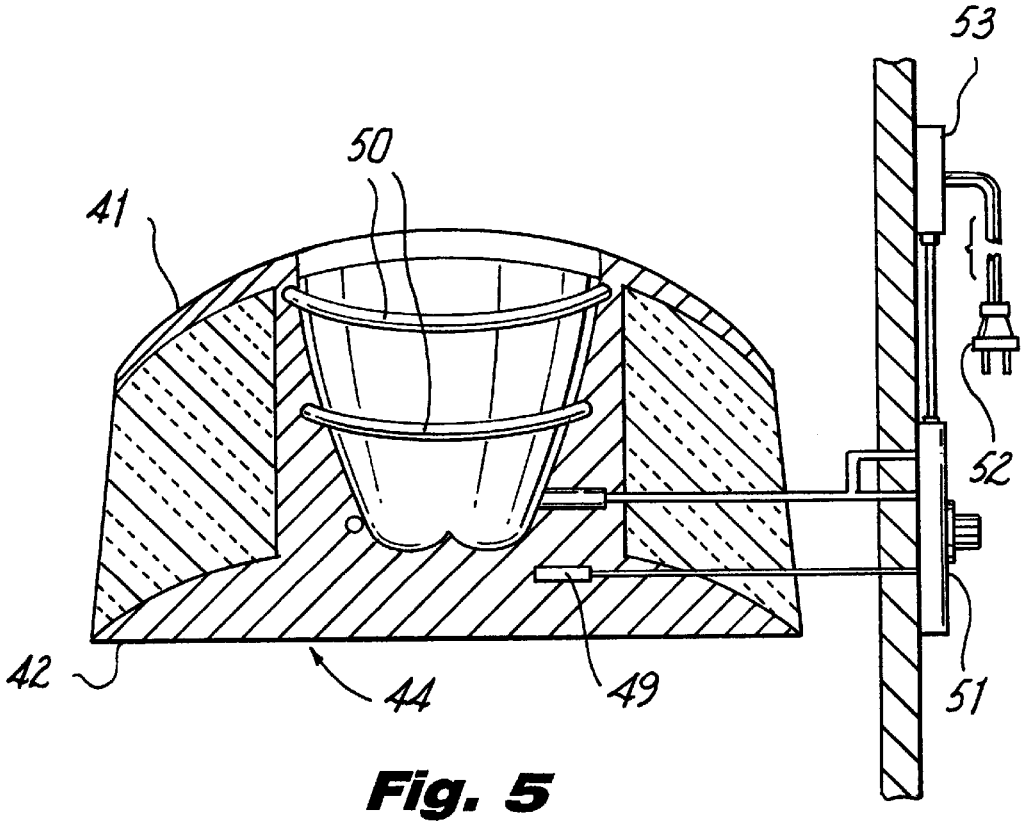
FIG. 5 is a side cross section showing heat rod elements of the female mold of the hat making machine of the present invention.

FIG. 4 shows the female mold with an electrically controlled steam admission valve 30 admitting steam through a small steam port 31 near the base 42 of the female mold assembly 40. The lower flange shape 41 for the brim is shown in partial cross section. The steam source 34 feeds steam through valve 30 to conduit 33 which is in communication with port 31. A plug 32 for electric supply conveys 110 volts AC. Insulating material 43 forms a heat shield around the cast mold 44 of female mold 40. Besides steam, heating rod element 50 wraps in a spiral configuration at strategic locations around female cast mold 44, as shown in FIG. 5. A temperature sensor 49 communicates with thermostat 51 to control the heat rod elements 50. Plug 52 supplies 220 volts AC to junction box 53 to supply the heating elements 50 as well as the "Jiffy" electric steam generator 34 (shown in FIG. 7) which supplies steam at 100 psig. Power line wire 45 connects heat rod 50 to thermostat 51 and junction box 53 and plug 52. Heat rod 50 is controlled to be consistently heated at 250° F.

Figure 6:
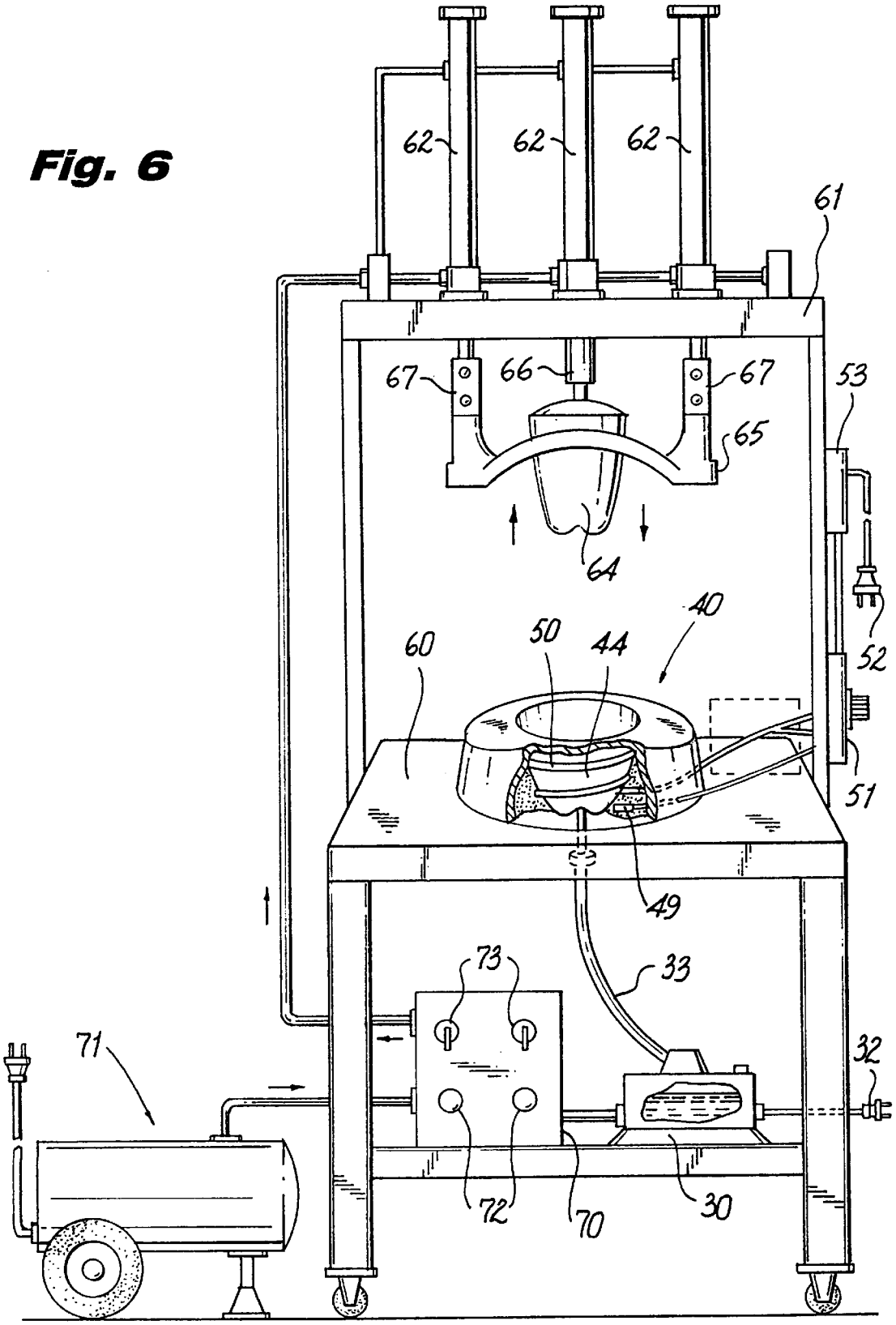
FIG. 6 is a front view of the automatic hat molding machine of the present invention.

FIG. 6 is a front view of the hat molding machine. The female mold subassembly 40 rests on bench 60. Frame assembly 61 supports pneumatic cylinders 62 and 63 as well as movable male mold 23, including flange mold 65 and movable male crown mold 64. The male mold crown shape 64 is attached to the rod of pneumatic cylinder 63 by coupling 66. Cylinders 62 which operate flange (brim) mold 65, are connected to the respective rods via coupling members 67. A pneumatic console 70 receives compressed air from compressor 71. Control button 72 is for automatic cycle operation while controls 73 are for manual operations.

Figure 7:
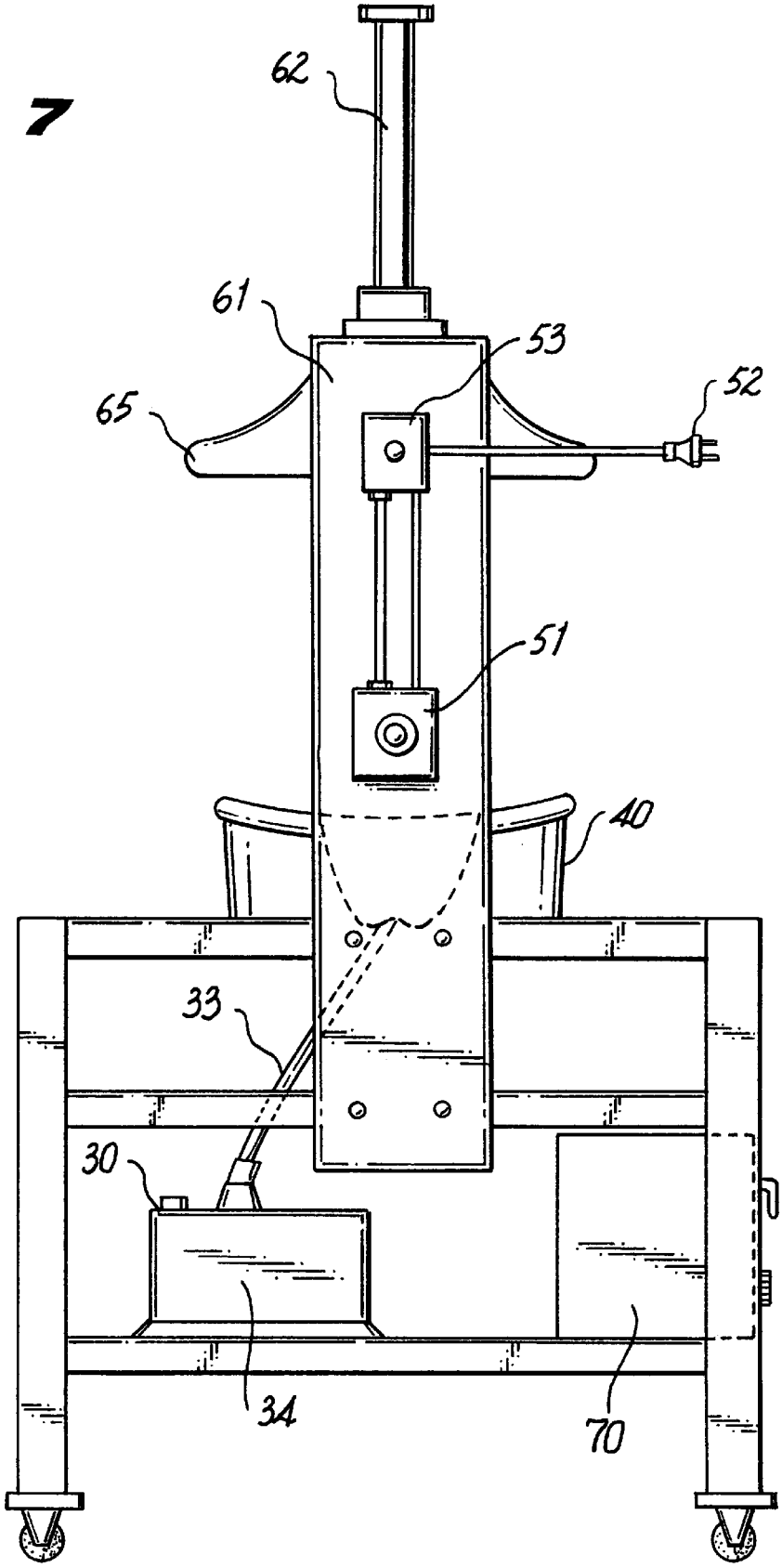
FIG. 7 is a side view of the automatic hat molding machine of the present invention.

FIG. 7 is a side view of the same machine.

It can be appreciated that cylinders 62 can operate independently from cylinder 63 so that physical pressure can be independently applied and controlled to the brim portion and the crown portion of the hat mold. Also, steam entry and heater rod temperature are also independently controlled. The cycle parameters are a function of the felt or wool material, the weight of the felt and the shape and size. The normal sequence of operations is as follows:

raw body is placed in the female mold;

a combination of steam is applied along with heat (typically 4 to 5 seconds);

the movable flange of the male hat mold is advanced down;

the separate male crown mold is advanced down;

the hat is left in the respective mold portions for a time period (of the order of 60 seconds);

the male crown mold portion is moved up away from the female mold;

the male brim flange mold is moved up away from the female mold; and, the molded hat is removed.

Although electric actuators and an electronic programmable controller can be used as a substitute, the preferred embodiment uses pneumatic cylinders and a programmable air control to move the mold pieces and to automate the sequence of operations as shown in the figures. The pneumatic controls and cylinders are cost effective, reliable, and easy to maintain.

Figure 8:
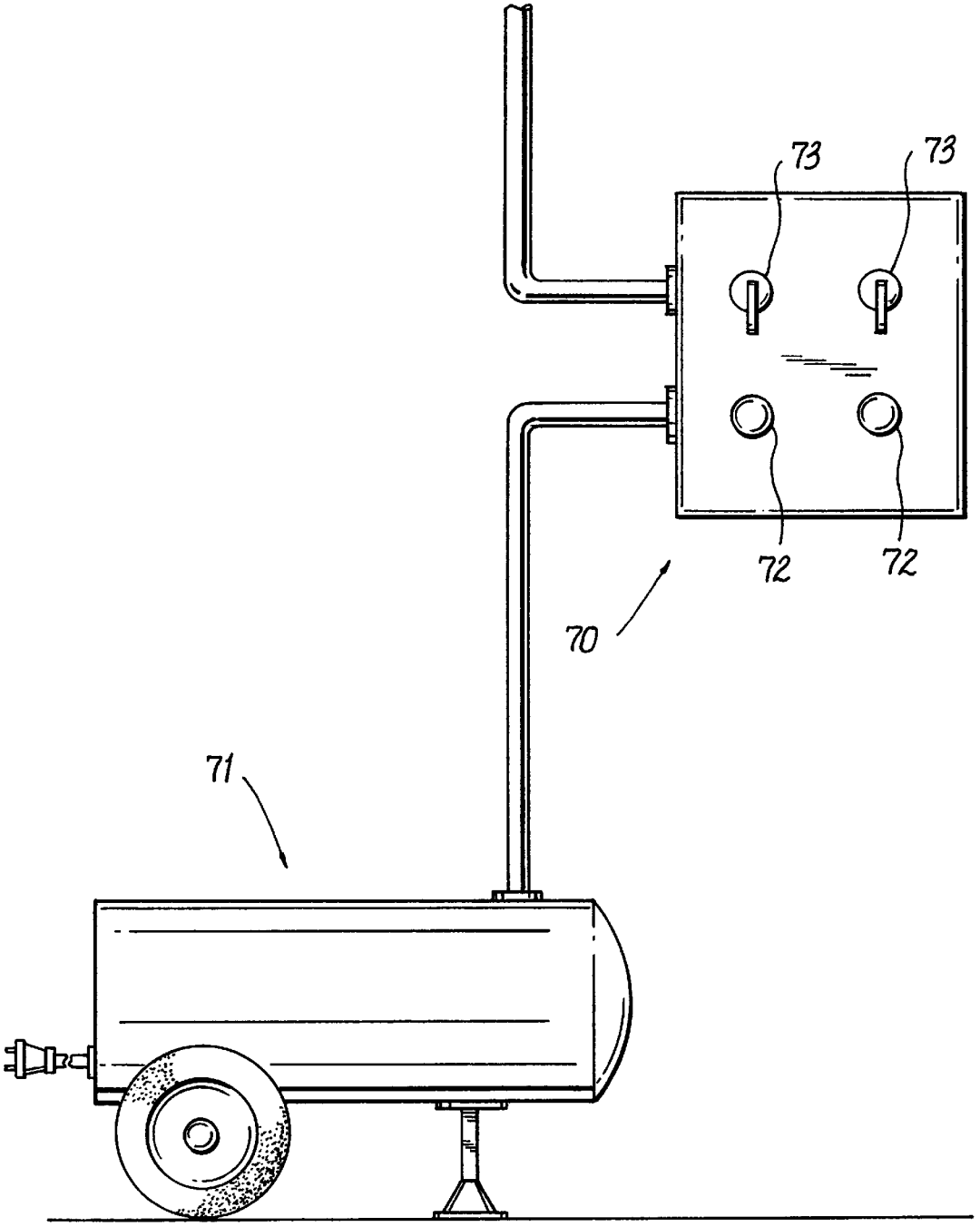
FIG. 8 shows a pneumatic subsystem of the hat making machine of the present invention.

FIG. 8 shows the stand alone electric compressor with integral storage tank connected to the pneumatic console 70. If the machine is used in an environment with available "shop air", a separate compressor would not be required.

Figure 9:
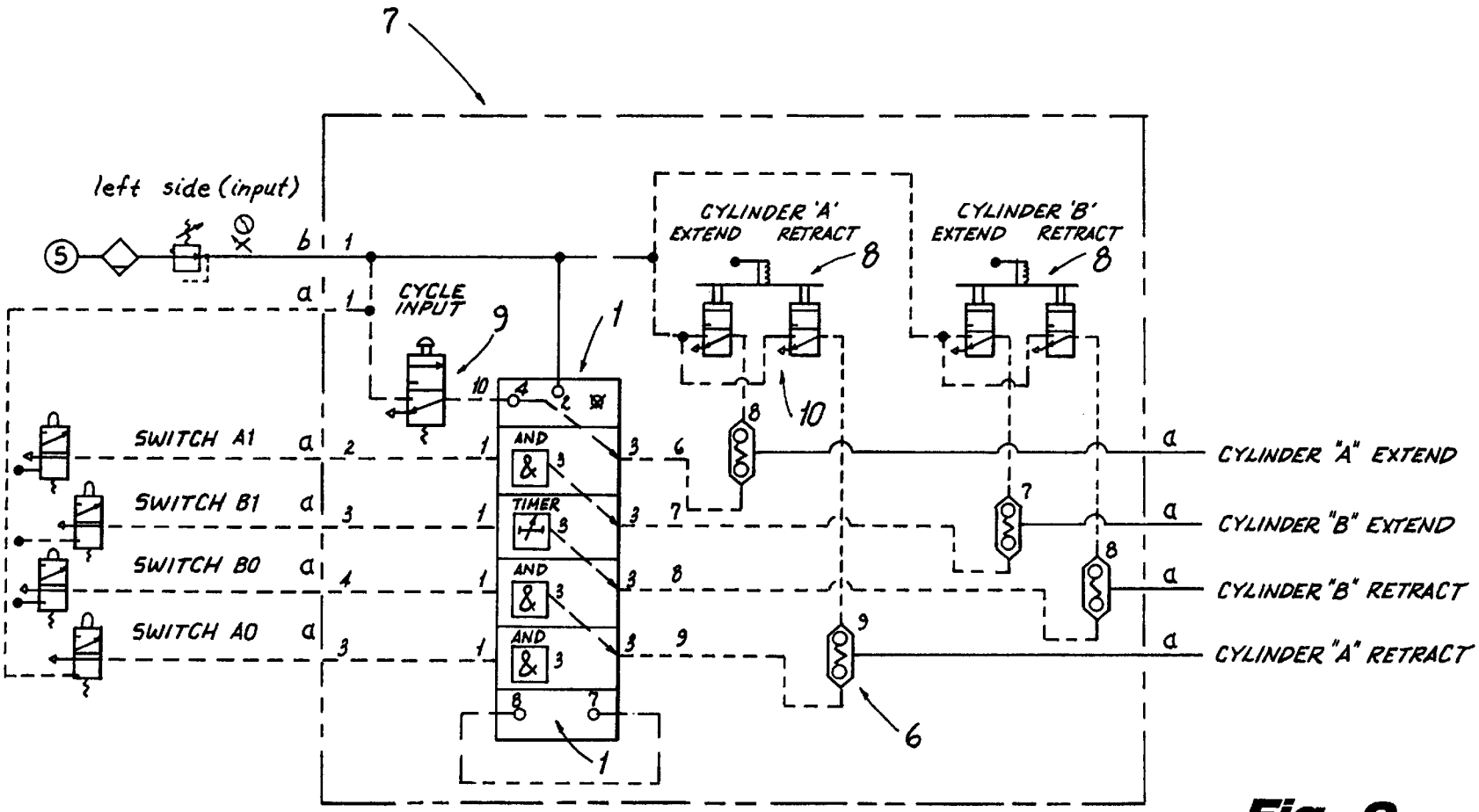
FIG. 9 is a schematic diagram of a programmable air control for the hat making machine of the present invention.

FIG. 9 shows the pneumatic schematic of the programmable air controller. The entry and exit modules 1 of the modular control assembly route the compressed air from the supply through the momentary control button 9 which starts the cycle.

Normally closed switches 10 are used as limit switches (A1, B1, A0, B0) to detect the positions of the cylinder rods in the fully extended or fully retracted positions.

In this nomenclature, cylinder A corresponds to the pair of cylinders 62 in FIG. 6, while cylinder B corresponds to cylinder 63 in FIG. 6. The "&" circuits 4 combine the "complete" signal from the block above with the input from the left in a logical "AND". The timer block 5 behaves like an "&" block with a delayed output where the duration of delay is set by the operator. The pneumatic "OR" elements 6 combine the two inputs to provide an output if either one or both of the inputs are active (ie. pressurized).

The three-way position selector switches 8 control the direction of the cylinders. The dotted outline 7 denotes an industrial type of enclosure or housing. The sequence of operations corresponding to this schematic supports the movements of the movable die elements as described in the "normal sequence" of operation detailed above.

In addition, pneumatic/electric switches controlled by other blocks in the same air controller (but not detailed in this schematic) are used to control the steam switch and the heater elements in the proper sequence for the desired duration.

Figure 10:
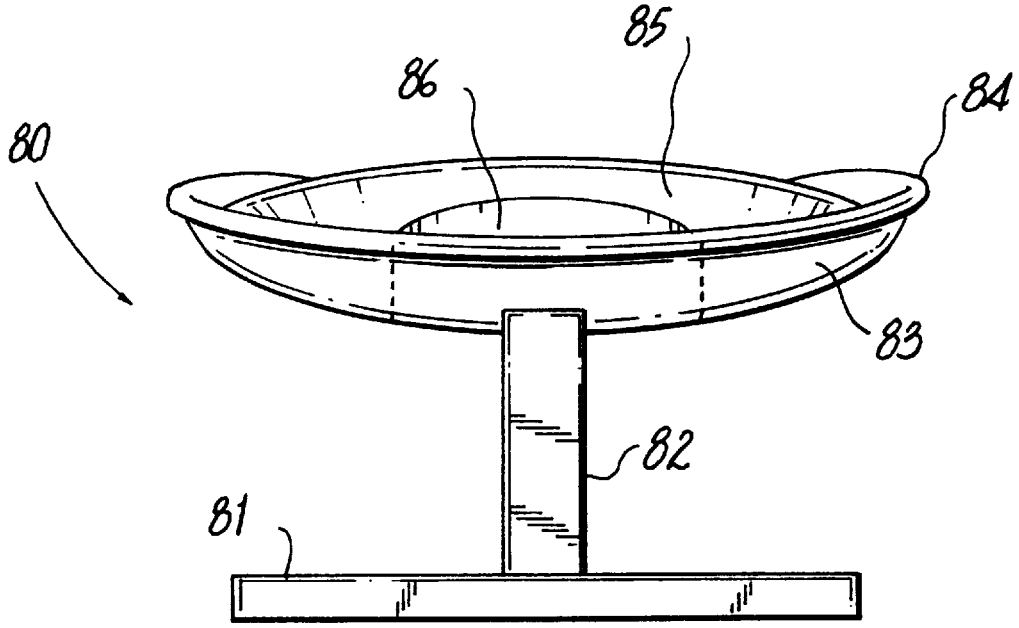
FIG. 10 is a perspective view of the cooling flange rack of the automatic hat molding machine as in FIGS. 6–7.
Figure 11:
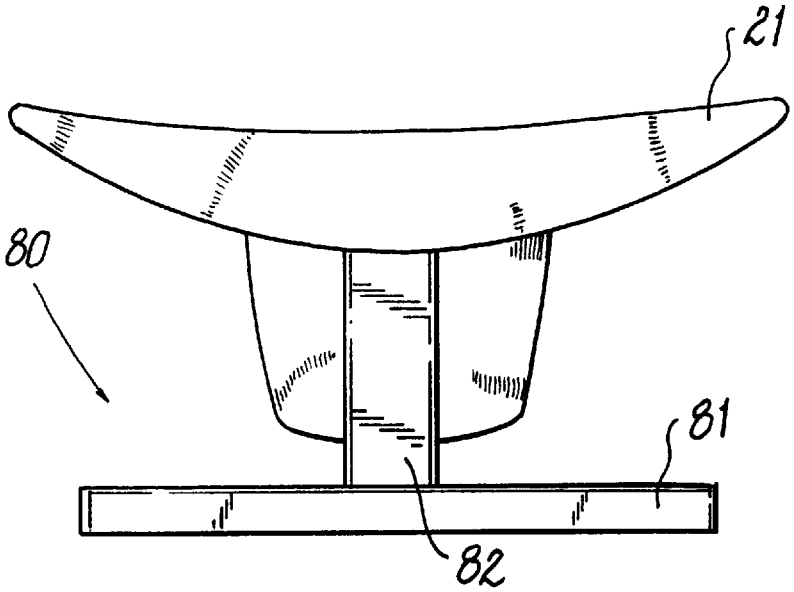
FIG. 11 is a perspective view of the cooling flange rack as in FIG. 8, shown with a hat thereon.
Figure 12:
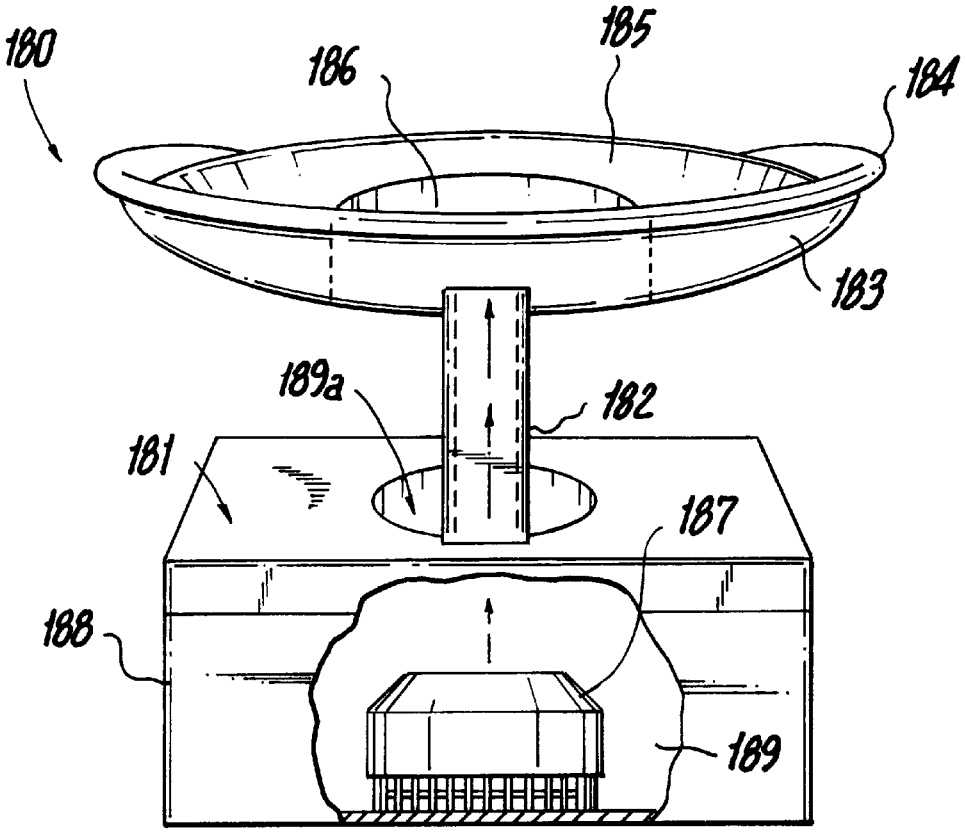
FIG. 12 shows a perspective view in partial cutaway of a cooling rack and an optional electric fan to speed the cooling cycle of a hat molding machine, as in FIG. 6.
Figure 13:
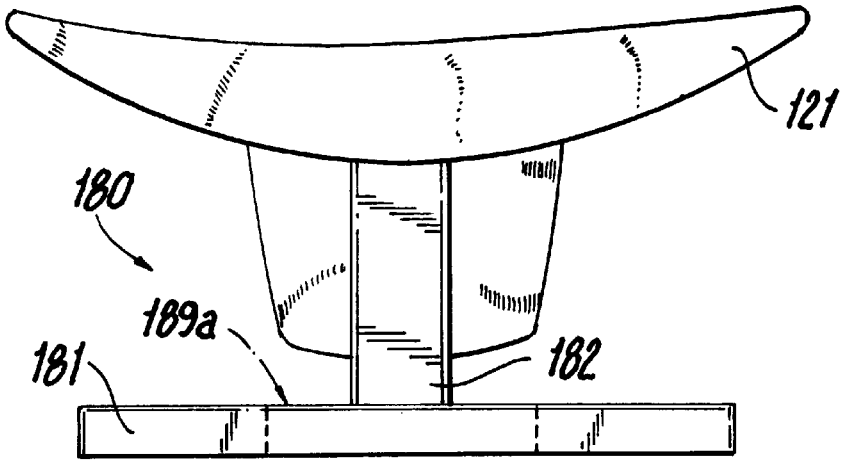
FIG. 13 is a side elevational view of the cooling rack, as in FIG. 12, with a molded hat in place.

As shown in FIGS. 10–11, when hat 21 is withdrawn from female mold 22 and male mold 23 in a heated condition, it is further shaped on cooling flange rack 80, which includes base 81, supporting post 82, which post 82 supports flange support 83 having outer rim 84, inner rim 85 and hole 86 for insertion of hat 21 therein.

Figure 14:
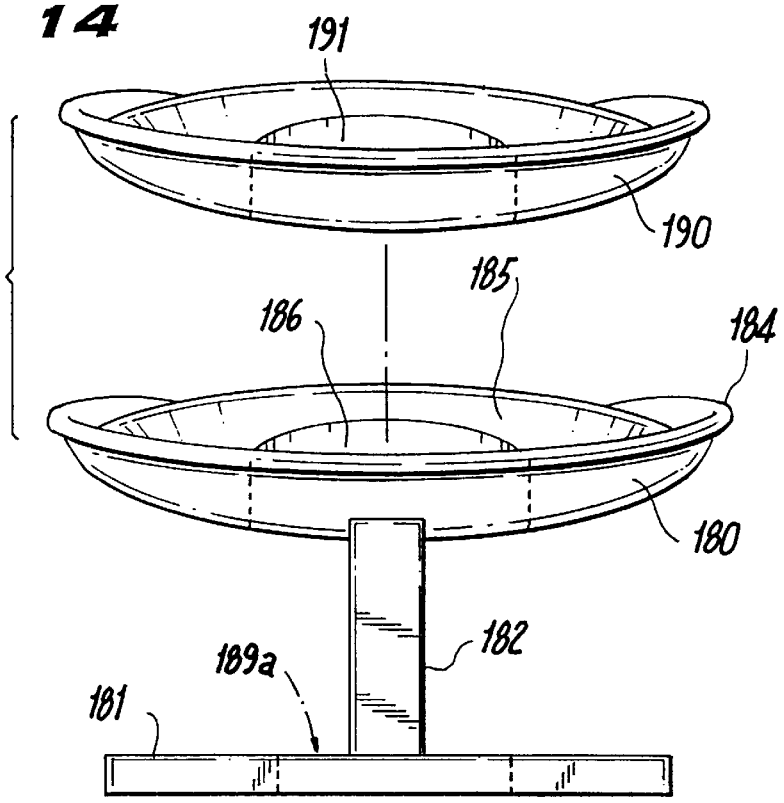
FIG. 14 shows the placement of a reduced shaped flange onto the cooling rack, as in FIG. 12.

As shown in FIGS. 12–18, cooling rack 180 includes base 181 upon table 188 with hole 189. Cooling rack 180 further has further hole 189*a* in register with table hole 189 and, supporting post 182 directing cooled air from fan 187 through hole 189 and further hole 189*a* to flange support 183 having outer rim 184, inner rim 185 and fenestration hole 186 for insertion of hat 121 therein. To reduce the hat size as shown in FIG. 14, reducer flange 190 having smaller fenestration hole 191 is placed upon support flange 180.

Figure 15:
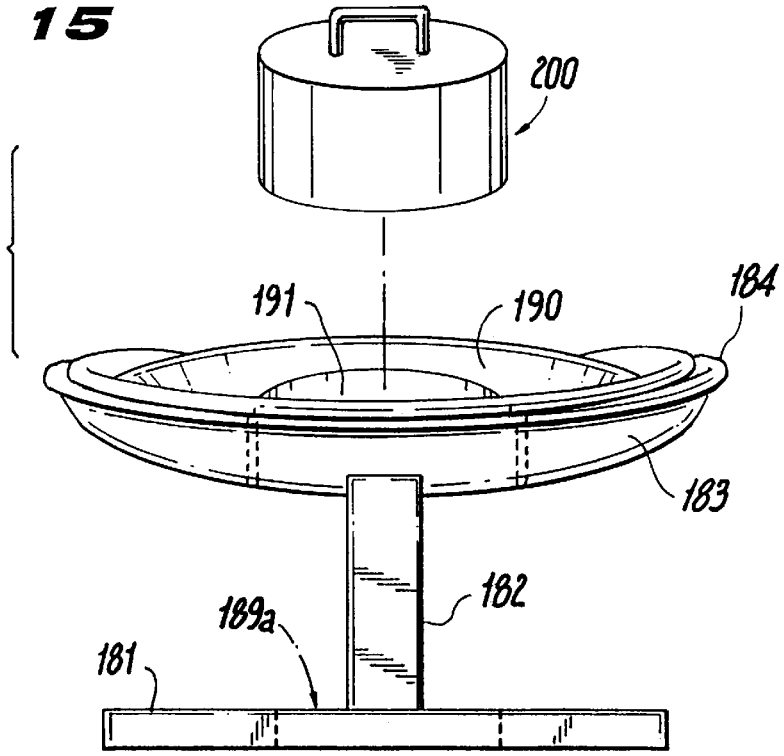
FIG. 15 shows in place a hat shaping flange with a reduced head size and a corresponding insert matching male sizing plug for a cooling cycle upon the cooling rack, as in FIG. 12.
Figure 16:
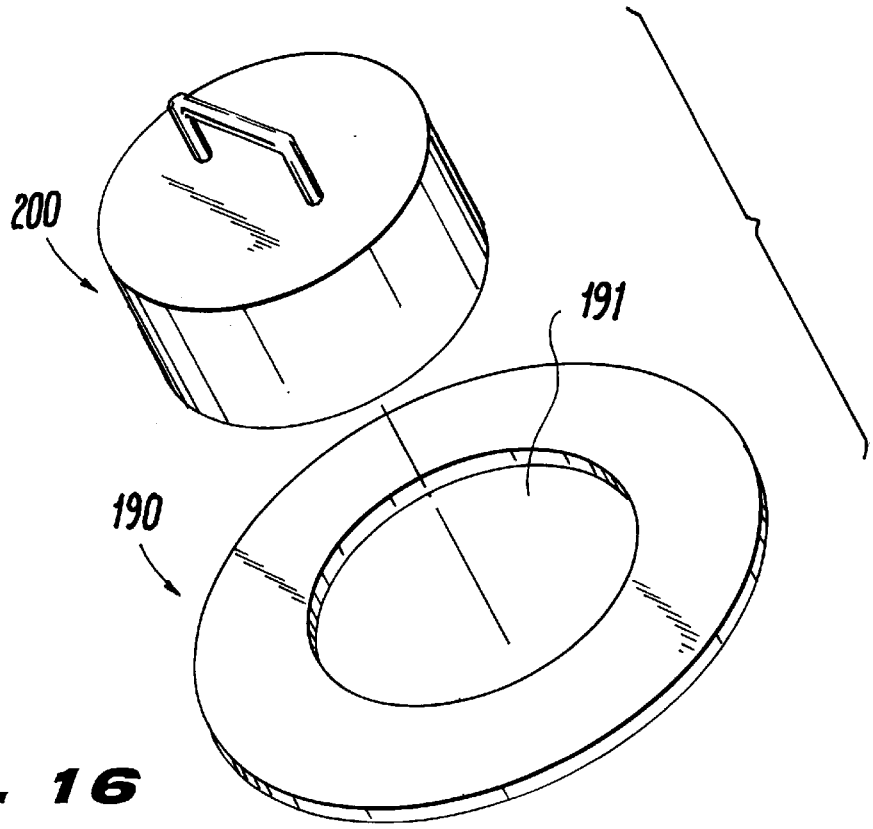
FIG. 16 is a top perspective view of the shaping flange of a predetermined large size, shown with a matching male plug.
Figure 17:
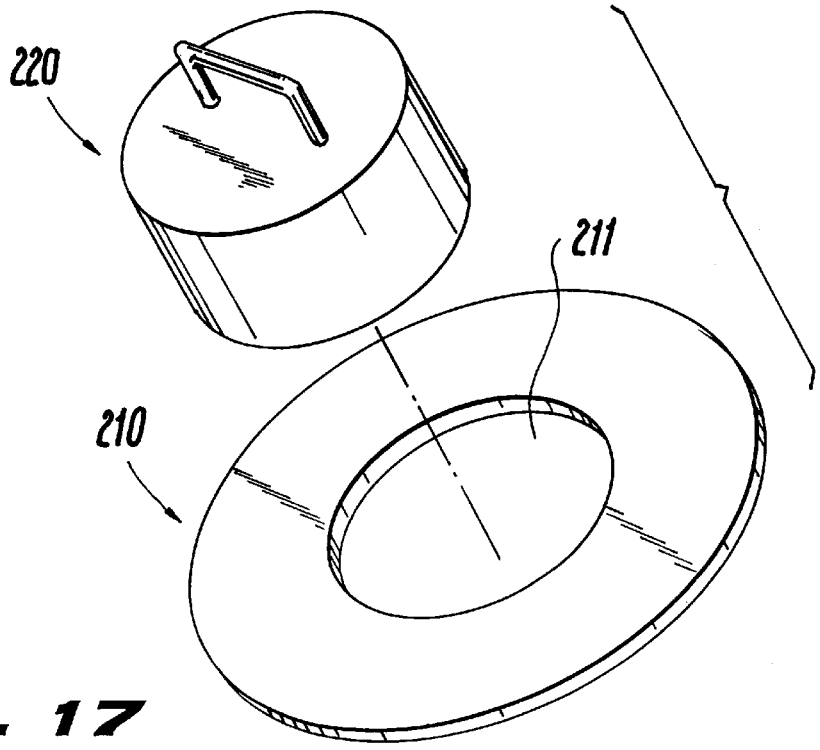
FIG. 17 is a top perspective view of the shaping flange of a predetermined smaller size, shown in a corresponding reduced size male plug.

FIG. 15 shows male plug 200 with an outer diameter corresponding to hole 191 of reducer flange 190, when a hat 121 is squeezed through smaller fenestration hole 191 of reducer flange 190, its size is thereby reduced. Moreover, as shown in FIG. 17, a further reduced size flange 210 with smaller fenestration hole 211 accommodates a further reduced size male plug 220.

Figure 18:
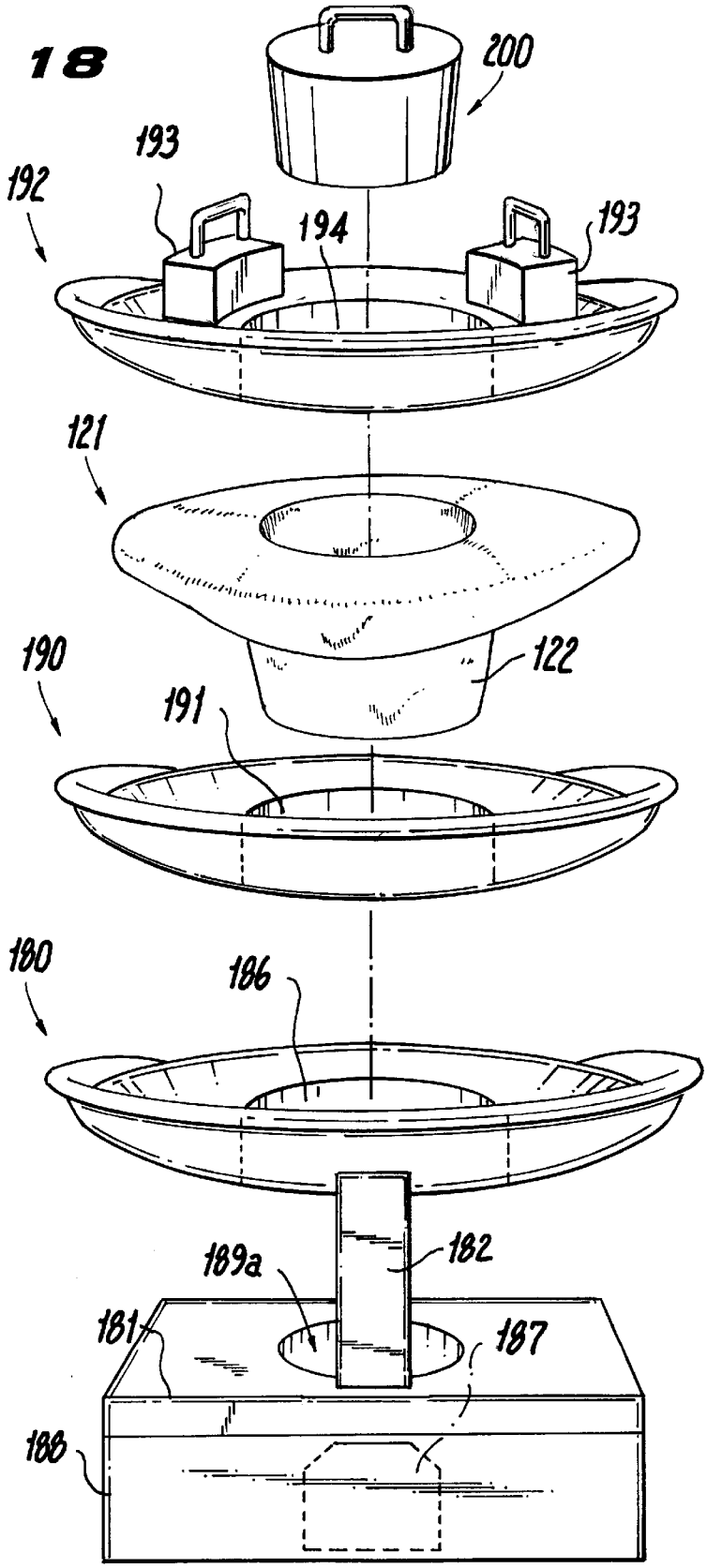
FIG. 18 is an exploded perspective view in partial cutaway showing the use of a size reducer insert crown and corresponding size ring support flange to produce a sized hat upon a cooling rack.

As shown in FIG. 18, optional weighted flange 192 with weights 193 and fenestration hole 194 may be placed upon hat 121 which sits on reducer flange 190 or 210. Male plug 200 is inserted with a crown portion 122 of hat 121, which crown portion 122 is squeezed to a smaller size through smaller hole 191 of reducer flange 190.

Figure 19:
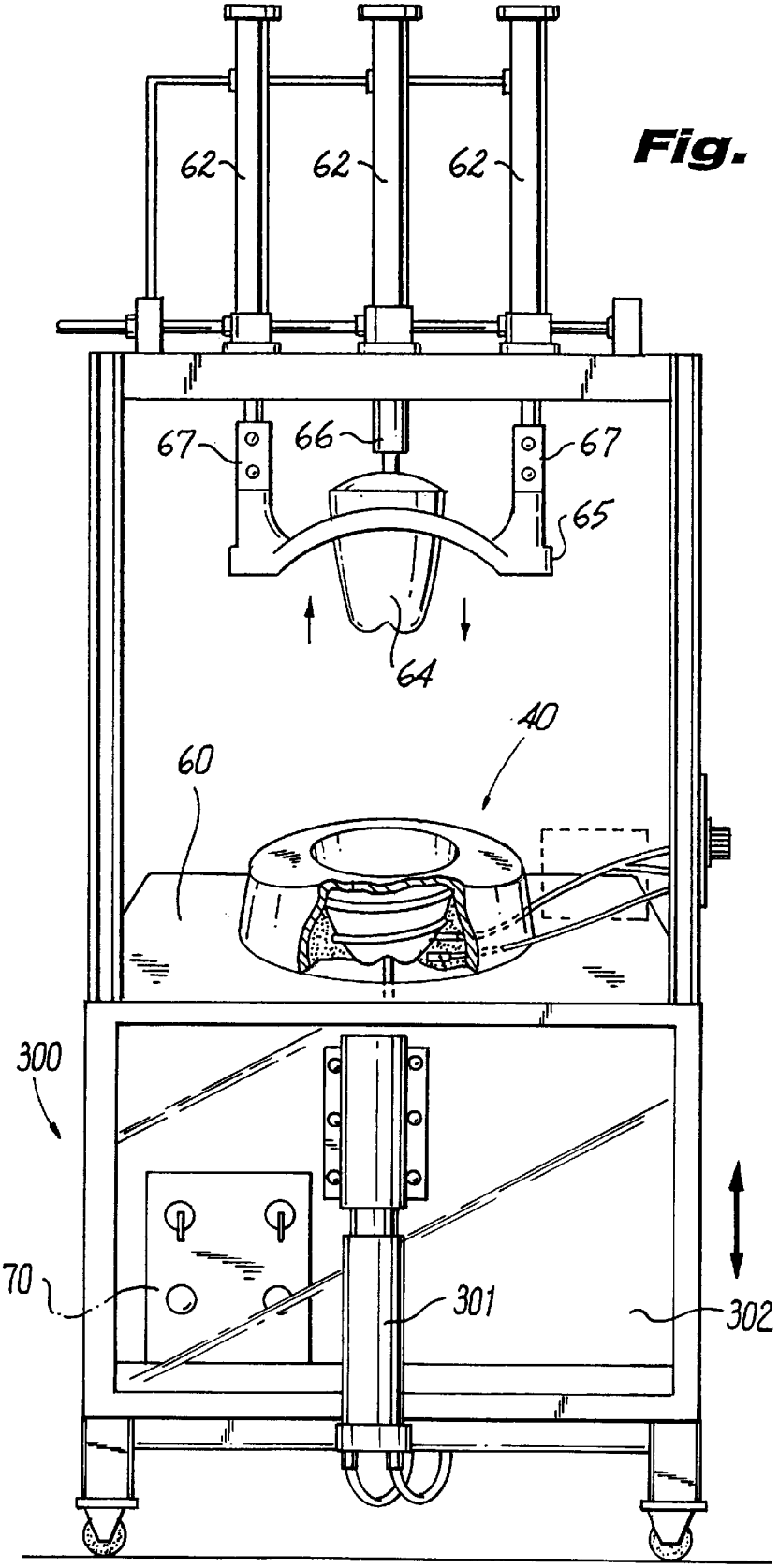
FIG. 19 is a front elevational view of the hat molding machine, as in FIG. 6, shown with a protective, movable guard.

As shown in FIG. 19, a safety screen gate assembly 300 with guard 302 is activated with the aid of a pneumatic cylinder 301 moving in a vertical direction within two stages. One stage in place as illustrated shows the blocking out of access to console control 70 of a hat molding machine. In a second stage, there is an upward direction movement of guard 302 which moves by a relay and stops in the area of the moving components of the hat molding machine. At that time, the auto mold machine is ready for final operation. Pressing of a second start relay at console 70 operates the hat molding procedure. At the end of a mold cycle, the safety gate 302 returns to block access to control console 70.

In addition to hat making, the hat making machine of the present invention can be also used for other applications, such as making pressed items, such as floor and wall parts of motor vehicles or other irregularly shaped structures, such as sound proofing panels, by varying the shape of the male and female mold respectively.

It is further know that other modifications may be made to the present invention, without departing from the scope of the invention as noted in the claims herein.

I claim:

1. A cooling hat sizer rack for use with a hat molding machine using advanced features to produce a completed hat form from an unshaped felt, wool or straw configuration form to a completed hat form shape, said machine including a movable crown shape portions and a corresponding female flange brim portion, said rack comprising:

a base supporting a support flange for a hat in a malleable state, at least one male hat crown insert plug and at least one reciprocal female reducer flange, said male hat crown plug having a movable crown portion, said movable portion of said male crown plug advancable against a crown of a malleable hat, said male plug insertable within a fenestration hole with said corresponding female reducer flange, said reducer flange removable adjacent to and supported by a female support flange upon said rack, said male hat plug and said reciprocal female hat reducer flange clamping the malleable hat form in a tight cavity formed therebetween, said male insert plug being insertable within said crown portion of the hat for a predetermined period of time sufficient to squeeze the malleable hat to a desired completed hat shape during cooling of the hat upon said cooling rack.

2. The cooling rack for a hat molding machine as in claim 1 further comprising a means to vary the sizes of hats made therewith, said means comprising said a plurality of male crown plugs corresponding to various sized hats, each of said male crown plugs removably insertable within a plurality of corresponding female flange members supported upon said cooling rack, said male plug and a fenestration hole of said female support flange reducing a first predetermined volume of said hat to a further smaller predetermined volume of said hat, said further smaller predetermined volume corresponding to a smaller hat size.

3. The cooling rack for a hat molding machine as in claim 1, further comprising at least one electric fan providing cooled air to the hat upon said rack.

* * * * *